US005239762A

United States Patent [19]

Grizzell

[11] Patent Number: 5,239,762

[45] Date of Patent: Aug. 31, 1993

[54] LAYOUT TOOL

[76] Inventor: James M. Grizzell, 8827 Swallow Way, Fair Oaks, Calif. 95628

[21] Appl. No.: 944,961

[22] Filed: Sep. 15, 1992

[51] Int. Cl.[5] ..... B43L 7/027

[52] U.S. Cl. ..... 33/474; 33/417; 33/476

[58] Field of Search ..... 33/474, 479, 480, 476, 33/417, 423, 562, 563, DIG. 16

[56] References Cited

U.S. PATENT DOCUMENTS

| | | | |
|---|---|---|---|
| D. 290,092 | 6/1987 | Bies . | |
| 383,242 | 5/1988 | Palmer, Jr. . | |
| 1,325,097 | 12/1919 | Lalor . | |
| 1,821,103 | 1/1929 | Luginbuhl . | |
| 2,173,348 | 9/1939 | Welch . | |
| 2,711,025 | 6/1955 | Natkie | 33/476 |
| 3,304,614 | 2/1967 | Adams . | |
| 3,373,496 | 3/1968 | Nelson | 33/423 |
| 3,456,353 | 7/1969 | Iams | 33/474 X |
| 3,513,552 | 5/1970 | Lagrosse . | |
| 4,499,666 | 2/1985 | Smith | 33/476 X |

*Primary Examiner*—William A. Cuchlinski, Jr.
*Assistant Examiner*—Alvin Wirthlin
*Attorney, Agent, or Firm*—Todd A. Noah

[57] ABSTRACT

A layout marking cut guide lines and drill hole locations on timber members during the construction of a timber structure. The layout tool is a quadrilateral planar body with a portion of one of its sides relieved to form a quadrilateral void. The layout tool has a calibrated linear guide slot and a calibrated arcuate guide slot used to measure and mark cut guide lines on rafters corresponding to various roof pitch angles. The layout tool may also have view holes for marking particular angled cut guide lines and drill holes for measuring the drill centers for foundation bolts on 2×4 and 2×6 timber members.

20 Claims, 6 Drawing Sheets

LAYOUT TOOL

TECHNICAL FIELD OF THE INVENTION

The present invention relates to a tool to be used by carpenters to expedite layout for timber framed structures.

BACKGROUND OF INVENTION

There are a number of existing devices that have been separately used by carpenters to assist in marking layouts of various dimensions, such as pitch angles of rafters. However, during the construction of timber structures, carpenters are confronted with a variety of layout tasks in addition to the cutting of rafters. Guide lines on numerous timber members need to be drawn in order to indicate the location of holes, the intersection of two or more members, and where specific cuts need to be made.

While the current devices may assist a carpenter in marking, e.g., pitch angles of rafters, they do not allow the carpenter to mark all of the most common lines or drill holes that arise in the framing of a structure. Therefore, the carpenter must carry additional tools and must remeasure the cut lines or drill holes for each piece of timber needed to be cut or drilled.

The layout tool of the present invention provides a means for marking all commonly encountered guide cut lines during the layout of a timber structure. The layout tool of the present invention combines several essential functions performed by a carpenter during the layout of a structure in a single device that fits easily into the carpenter's nail pouch.

SUMMARY OF THE INVENTION

One object of the present invention is to provide a layout tool which facilitates the expeditious marking of guide lines for end cuts on common rafters and hip and valley members corresponding to any one of a number of preselected roof pitches.

A further object of the present invention is to provide a tool for the expeditious marking of channels on the top and bottom plates of walls.

Another object of the invention is to provide a tool with view holes for marking preselected angular cuts on top and bottom plates.

Yet another object of the present invention is to provide a tool for marking drill holes for onehalf inch bolts used to mount bottom plates to the foundation of a structure.

Still another object of the present invention is to provide a tool for the expeditious marking of plumb and level cuts on the ends of rafter members.

In fulfillment of these and other objects, the layout tool of the present invention has a substantially quadrilateral planar body and a plurality of pivot pins. A first straight edge is opposite and substantially parallel to a second edge wherein a portion of the second edge is relieved to form a substantially quadrilateral void. The other two of the edges of the planar body are straight and substantially parallel to each other. Adjacent to the corner formed by the intersection of the first and third edges, there is a first pivot pin location for receiving a first pivot pin. Adjacent to the third edge at a predetermined distance from the first location and aligned with the first edge approximately equidistant with the first location from the first edge, there is a second pivot pin location for receiving a second pivot pin.

The body of the layout tool further comprises a linear guide slot located substantially parallel to and adjacent to the fourth edge. The region of the body adjacent to the linear slot has marks corresponding to a preselected set of pitch angles. There is also an arcuate guide slot located substantially radially from the first pivot pin hole. The region of the body adjacent the arcuate slot has marks corresponding to a preselected set of degree graduations.

In one embodiment, the layout tool may be provided with view holes for marking cut guide lines at fixed angles and drill holes for measuring drill centers on top and bottom plates.

Objects and advantages other than those set forth above will be apparent from the following description when read in conjunction with the accompanying drawings.

DETAILED DESCRIPTION OF THE INVENTION

Figure 1:
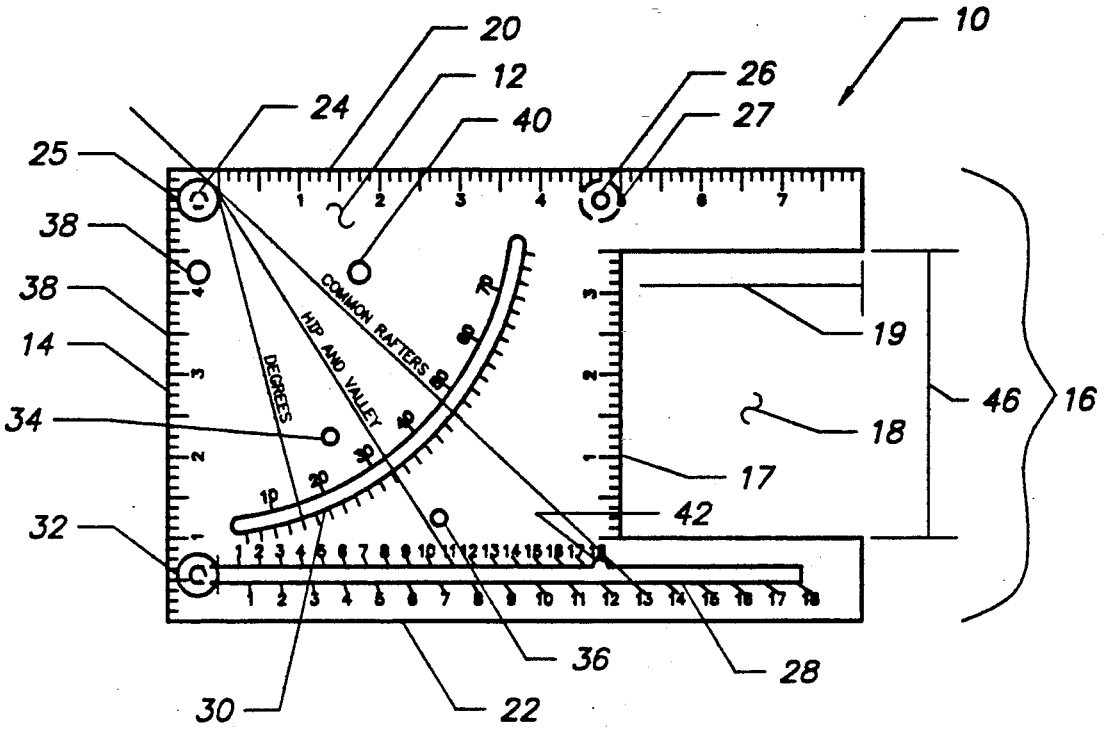
FIG. 1 is a plan view showing the two primary pivot pin locations (solid lines) and the secondary pivot pin locations (dashed lines).

As shown in FIG. 1, the layout tool 10 includes a quadrilateral substantially planar body 12 and a plurality of pivot pin locations. The planar body has a first edge 14, a second edge 16, a third edge 20 and a fourth edge 22. The second edge 16 has a relieved portion 17 which forms a substantially quadrilateral void 18. The regions of the body adjacent to the first edge 14, the third edge 20 and the relieved portion 17 of the second edge 16 are marked in linear measure. The layout tool may be constructed from any rigid material such as metal, plastic or wood.

In one embodiment, the length 46 of relieved portion 17 is approximately 3.5 inches, the depth 19 of the quadrilateral void is approximately 3 inches, the lengths of the third edge 20 and the fourth edge 22 are approximately 8.625 inches and the lengths of the first edge 14 and the second edge 16 are approximately 5.5 inches.

As further shown in FIG. 1, the layout tool body 12 has a linear guide slot 28 located substantially parallel to and adjacent to the fourth edge 22 of the body 12 and is capable of recieving a pivot pin 32.

In one embodiment, the linear guide slot 28 has a detent 42 at a predetermined distance from the first edge 14 and is aligned equidistant with the second pivot pin hole 26 from the first edge 14. This notch forms a void in the body 12 along the guide slot 28 and may be in the shape of a semi-circle, a triangle or a quadrilateral.

The region of the body 12 adjacent to the linear guide slot has two sets of marks, one set for marking cut guide lines on common rafters and one set for marking hip and valley members simulative to a pitch corresponding to the associated mark. Referring again to FIG. 1, there is an arcuate guide slot 30 positioned substantially radially from the first pivot pin hole 24. Like the linear guide slot 28, the arcuate slot 30 is capable of receiving a pivot pin. The region of the body 12 adjacent to the arcuate slot 30 is marked with degree calibrations.

Figure 2:
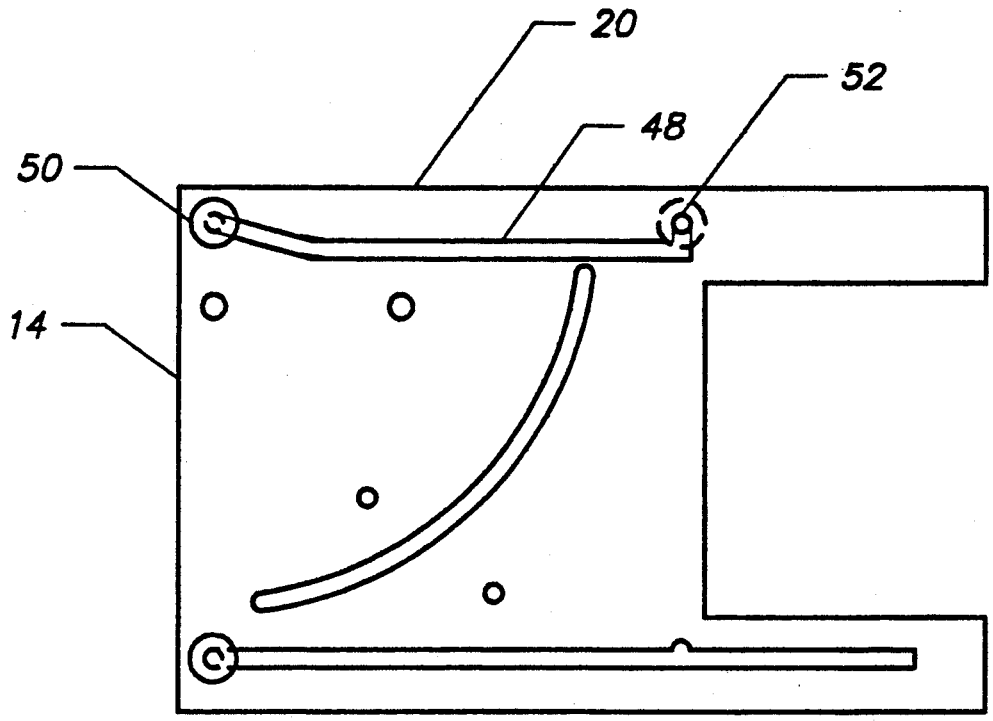
FIG. 2 is a plan view showing the layout tool according to a second embodiment.

The layout tool further includes a first and second means for receiving a pivot pin. These means may be pivot pin holes as shown in FIG. 1 or may be first and second ends of a guide slot as shown in FIG. 2. These embodiments are described more fully below.

As shown in FIG. 1, adjacent to the corner formed by the intersection of the first edge 14 and the third edge 20, there is a first pivot pin hole 24 capable of receiving pivot pin 25. Adjacent to the third edge at a predetermined distance from the pivot pin hole 24 and aligned approximately equidistant from the third edge 20 with the first pivot pin hole 24, there is a second pivot pin hole 26, capable of receiving pivot pin 27.

In another embodiment of the layout tool as seen in FIG. 2, a third guide slot 48 may be used as the first and second means for receving a pivot pin in place of the first and second pivot pin holes shown in FIG. 1. The third guide slot 48 is located substantially adjacent to the third edge 20.

Referring again to FIG. 2, the first end 50 of the third guide slot 48 is adjacent to the corner formed by the intersection of the first edge 14 and the third edge 20 and the second end 52 is adjacent to the third edge 20 at a predetermined distance from the first end 50 and aligned approximately equidistant from the third edge 20 with the first end 50. When a pivot pin is positioned at either end of the third guide slot 48, it will be secured to the layout tool in the same location as if it was secured in the respective pivot pin hole as described above for FIG. 1. The third guide slot 48 may be comprised of linear segments or it may have a simple or complex curve (as shown by the dotted lines in FIG. 2).

The advantage of using the third guide slot 48 is that the carpenter does not have to remove the pivot pin from the layout tool when switching pivot pin locations in the third guide slot 48 as would be required if the pivot pin locations 24 and 26 shown in FIG. 1 were used.

The use of pivot pins in the present invention is advantageous in the layout of timber structures because it minimizes the inaccuracy of the current devices due to surface irregularity of timber members. In marking cut guide lines on timber members, current devices employ a straight edge which is engaged with an edge of a piece of timber to be marked. This is disadvantageous because the section of the edge of the timber engaged with the straight edge of the device may not be perfectly straight. The layout tool of the present invention minimizes this problem by reducing the amount of contact of the layout tool along the edge of the timber member to two points; the two points at which the pivot pins contact the timber member.

Figure 3:
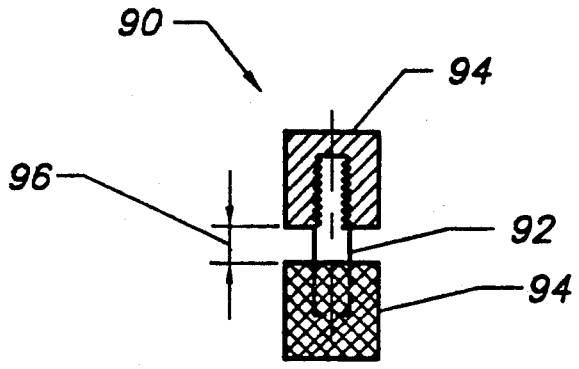
FIG. 3 is a detail of a pivot pin according to one embodiment.

One embodiment of a pivot pin that can be used in the present invention is shown in FIG. 3. In this embodiment, pivot pin 90 consists of two cylindrical caps 94 removably secured to each other by a stud 92. The stud 92 may be threaded at both ends or at only one end with the other end permanently fixed in a cylindrical cap 94. The portion 96 of the stud 92 surface that is not threaded or not permanently fixed in a cylindrical cap 94 matches the thickness of the body of the layout tool. The pivot pin 90 may be removably secured in various locations in the layout tool. The location will depend upon the particular function to be performed. The outer surface of the cylindrical caps 94 may be smooth or gnurled. The pivot pin 90 may be constructed from metal, wood, plastic or any other rigid material.

The layout tool of the present invention can be used with two or more pivot pins positioned in any of the pivot pin holes or slots. Ideally, the layout tool functions better with two pivot pins.

Furthermore, although the layout tool of the present invention is pictured in the figures as suitable for use by a right-handed carpenter, it can also be arranged in the mirror image for ease of use by left-handed carpenters.

In order that the invention described herein may be more fully understood, FIGS. 4–8 show various functions the layout tool can perform. These figures are not intended to limit the scope of the invention in any manner as there are many other functions the layout tool can perform within the scope of the present invention.

Marking End Cuts on Common Rafters and Hip and Valley Members

Figure 4:
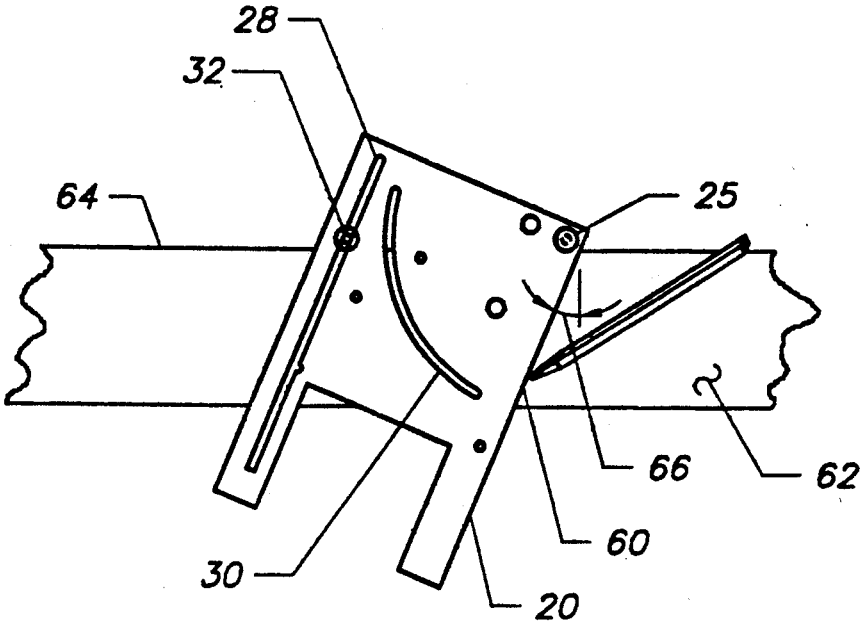
FIG. 4 is a plan view of the layout tool illustrating the function of marking end cuts on common rafters and hip and valley members.

As shown in FIG. 4, the layout tool of the present invention may be used to expeditiously layout end cuts on common rafters and hip and valley members at the angle required to provide a desired roof pitch. Numbers representing the ratio of rise to trun, for common rafters, expressed as a whole number (the numerator) with an assumed denominator of 12 are inscribed along one side adjacent to the linear guide slot 28. The marks corresponding to the predetermined pitches mentioned above, as they apply to hip and valley members, are inscribed on the opposite side of the linear guide slot as that mentioned above.

With a pivot pin secured in location 24, the tool is positioned such that the edge of the timber member 64 is tangent to the circumference of the pivot pin and in line with the preselected roof pitch mark. When positioned as such the third edge 20 of the layout tool may be used to mark a cut guide line 60 on the exposed face of the rafter at an angle 66. The angle 66 of the cut guide line is simulative to a common rafter, hip member or valley member having a pitch corresponding to the mark along the guide slot 28. Once the pivot pin 32 is secured at the selected mark, the layout tool can be used to mark cut guide lines on multiple members without further adjustment or measurement.

As further shown in FIG. 4, a carpenter may use the arcuate slot 30 in connection with pivot pins 25 and 32 to expeditiously mark a cut guide line 60 at a particular angle. To do this, the layout tool is placed upon the exposed face of a rafter 62 such that the pivot pin 25 is engaged with the side edge 64 of the member 62. The layout tool is then rotated about the pivot pin 25 until one of the degree marks along the arcuate slot 30, corresponding to the desired angle 66 of the cut guide line 60, is aligned with the edge 64 of the member 62. If desired, the pivot pin 32 can be positioned in the linear guide slot 32 and tightened at a position conducive to producing the desired angle 66. The layout tool may then be used to mark a cut guide line 60 on the exposed face of multiple members at an angle 66 without further adjustment or measurement.

Marking Plumb and Level Cuts on Common Rafters and Hip and Valley Members

Figure 5:
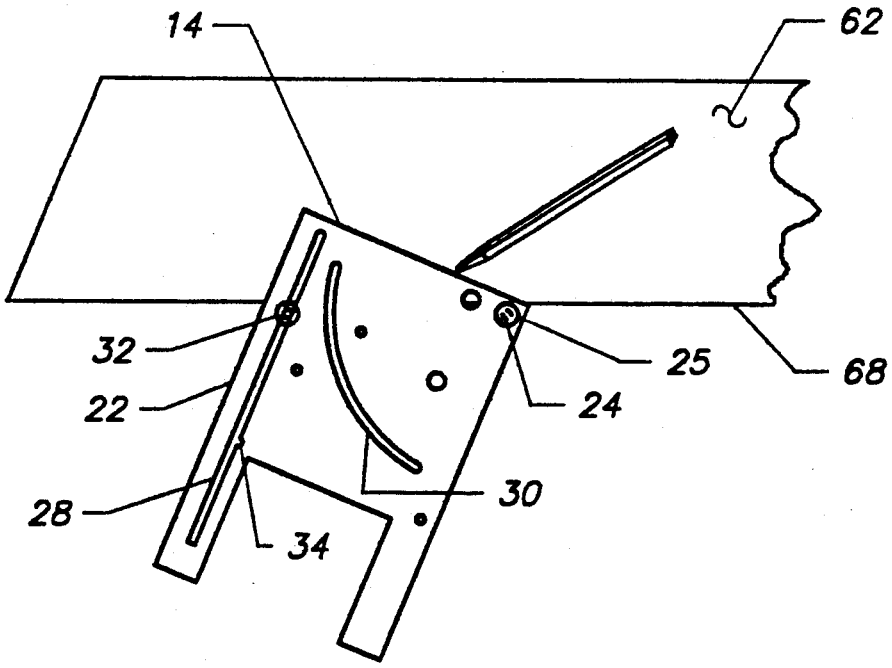
FIG. 5 is a plan view of the layout tool illustrating the function of marking plumb and level cuts on the ends of rafters.

As shown in FIG. 5, the arcuate slot 30 may also be used in conjunction with the pivot pins 25 and 32 to mark guide lines for plumb and level cuts on common rafters and hip and valley members. The position of pivot pin 32 in the linear guide slot 28 is selected in the same manner described above with respect to FIG. 4 for selecting the desired angle of the cut guide lines for end cuts on common rafters and hip and valley members. However, for plumb and level cuts, the pivot pins 25 and 32 are aligned with the opposite side edge 68 of the rafter 62 such that the mark for a level cut is made along the first edge 14 and the mark for a plumb cut is made along the fourth edge 22. Again, the advantage of using the layout tool of the present invention for plumb and level cuts is that by one simple adjustment of the pivot pin 32, the carpenter can make plumb and level cut guide lines on multiple rafters without having to measure each cut.

Marking Channels on Top and Bottom Plates

Another task required in laying out a timber structure is marking channels for top and bottom plates of walls. None of the current devices allow a carpenter to mark channels without having to remeasure each channel. The layout tool of the present invention, however, can be used to mark channels for top and bottom plates of walls without having to remeasure.

Figure 6:
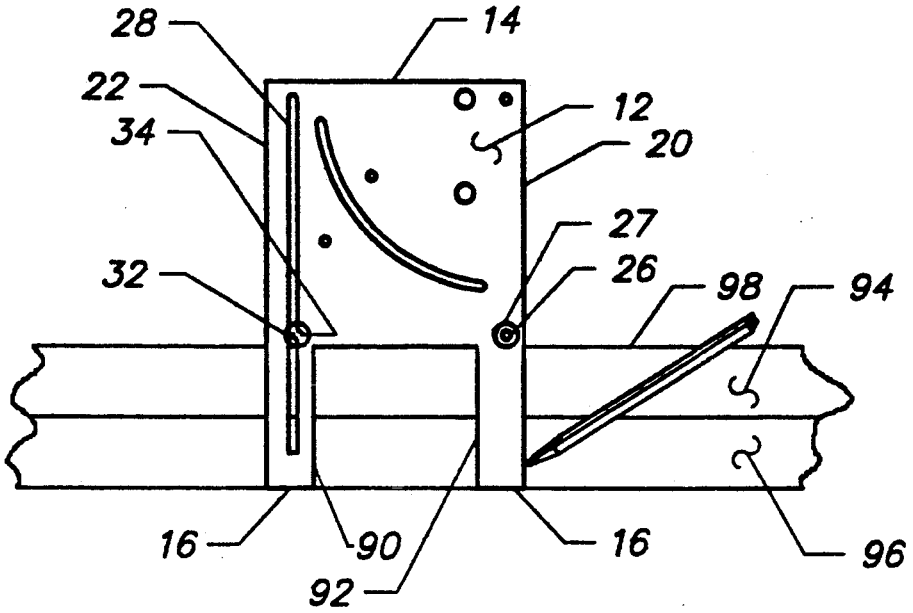
FIG. 6 is a plan view of the layout tool illustrating the function of marking channels on top and bottom plates.

As shown in FIG. 6, a pivot pin 27 is secured in pivot pin location 26 and a pivot pin 32 is secured in the linear guide slot 28 at a distance equidistant with the pivot pin 27 from the third edge 14 of the body 12. In one embodiment, pivot pin 32 is secured in detent 34.

The layout tool is placed against the side edges 94 and 96 of a top and bottom plate stacked on top of one another. The pivot pins 32 and 27 are engaged with the exposed face 98 of the top plate. The carpenter can mark a channel for 2×4 top and bottom plates by using edges 90 and 92 and a channel for 2×6 top and bottom plates by using third edge 20 and fourth edge 22. Once the pivot pins 32 and 27 are secured in these positions, the layout tool can be used to mark guide lines for channels on multiple top and bottom plates without having to make repeated measurements or adjustments.

Marking Cut Guide Lines on Top and Bottom Plates

Figure 7:
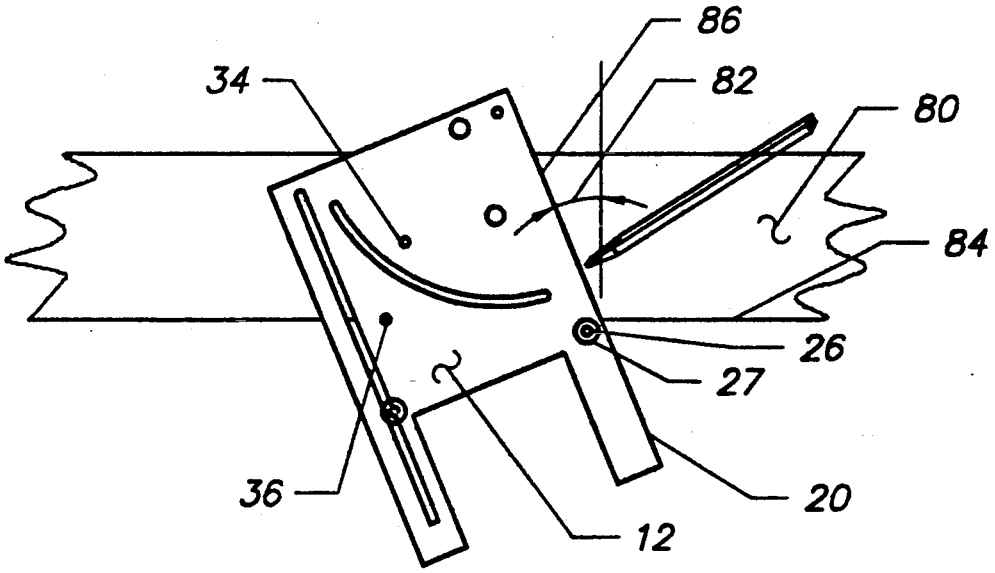
FIG. 7 is a plan view of the layout tool illustrating the function of marking twenty two and one-half degree and forty five degree cut lines on top or bottom plates according to one embodiment.

In another embodiment of the layout tool, the body 12, as seen in FIG. 1, may also have a first view hole 34 located between the arcuate slot 30 and the first pivot pin hole 24, and a second view hole 36 located between the arcuate slot 3 and the linear slot 28. As shown in FIG. 7 and described below, these view holes are positioned in the body of the layout tool such that the third edge 20 can be used to mark a cut guide line 86 on top and bottom plates at any predetermined angle 82. The angle 82 is specific for each view hole.

Accordingly, to mark cut guide lines using a view hole, the layout tool, with pivot pin 27 secured in pivot pin location 26, is placed upon the exposed face 80 of a top or bottom plate such that pivot pin 27 is engaged to the bottom side edge 84 of the top or bottom plate. The layout tool is rotated about pivot pin 27 until the center of the view hole 36 or view hole 34, depending upon the desired angle 82 of the cut guide line, is aligned with the side edge 84. In this position, the third edge 20 can be used to mark a cut guide line 86 on the top or bottom plate at an angle 82.

In one embodiment, view hole 36 is located in the body 12, such that when the center of view hole 36 is aligned with the bottom edge 84 of the top or bottom plate, the third edge 20 of the layout tool can be used to mark a cut guide line 86 at an angle 82 of twenty two and one-half degrees. Similarly, view hole 34 is located in the body 12, such that when the center of view hole 34 is aligned with the bottom edge 84 of the top or bottom plate, the third edge 20 of the layout tool can be used to mark a cut guide line 86 at an angle 82 of forty-five degree.

These view holes allow the carpenter to advantageously mark multiple cut guide lines at predetermined angles without having to measure the angle of the cut guide line for each cut.

Marking Drill Centers on Bottom Plates

In another embodiment, the layout tool 10, as shown in FIG. 1, has a first drill hole 38 and a second drill hole 40. The first drill hole 38 is located adjacent to the first edge 14 at a predetermined distance form the third edge 20. The second drill hole 40 is located between the first drill hole 38 and the arcuate slot at a predetermined distance from the the first edge 14 and is aligned approximately equidistant with the first drill hole 38 from the third edge 20.

The drill holes 40 and 38 may be used by the carpenter to mark drill centers for one-half in cast in place bolts which secure bottom plates to the foundation of a timber structure. This function is significant because during the layout of a structure, the carpenter must secure numerous bottom plates to the foundation. The layout tool of the present invention allows the carpenter to make multiple and precise drill center marks for foundation bolts, of a specific diameter, on bottom plates without having to measure for each bolt. This saves the carpenter a great deal of valuable time.

Ideally, the centers of the cast in place bolts are positioned at a point equidistant from the edge of foundation 92 and the interior wall layout line. Placement of the bolts in the ideal location when the foundation is poured is seldom obtained due to inaccuracies which result from the level of care exercised during placement.

Figure 8:
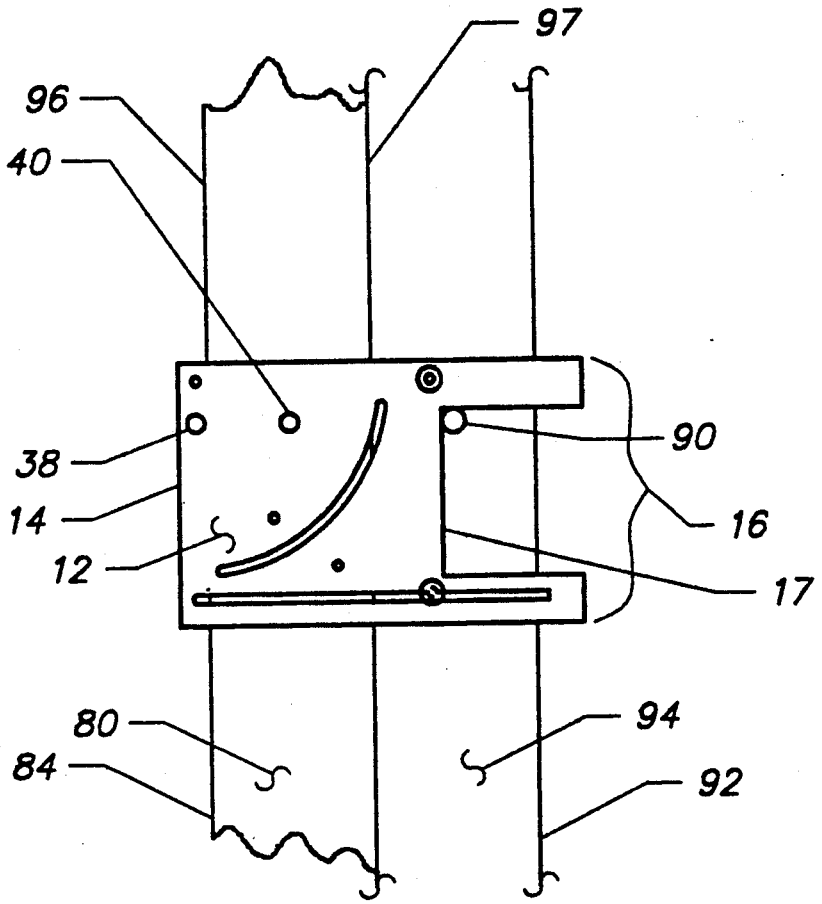
FIG. 8 is a plan view of the layout tool illustrating the function of marking drill centers on bottom plates for one-half inch cast in place bolts.

As shown in FIG. 8, to mark a drill center on a bottom plate, the carpenter first must position a bottom plate 84 with one edge aligned with the interior wall layout line often indicated with a snap line 97.

The layout tool is placed on the exposed face 80 of the bottom plates 84 and 92 such that the relieved portion 17 of the second edge 16 is engaged with the bolt 90. The layout tool is rotated about the bolt 90 until the first edge 14 is parallel to the edge 96 of the bottom plate 84. A drill center on the bottom plate 84 is marked through the center of the drill hole 40.

In a preferred embodiment, drill hole 38 is located in the body 12 such that the layout tool can be used to mark drill hole centers in 2×6 bottom plates. Similarly, drill hole 40 is located in the body 12 such that the layout tool can be used to mark drill hole centers in 2×4 bottom plates. The preferred diameters of drill holes 38 and 40 are three-eighths of an inch.

While the present invention has been described in detail by way of illustration and example for purposes of clarity of understanding, it is understood that certain changes and modifications may be made within the spirit of the invention and the scope of the appended claims.

What is claimed is:

1. A layout tool comprising:

a) a quadrilateral substantially planar body comprising:

i) a first edge, a second edge opposite and substantially parallel to said first edge wherein a portion of said second edge is relieved to form a substantially quadrilateral void, a third edge intersecting said first and second edges, and a fourth edge intersecting said first and second edges and substantially parallel to said third edge;

ii) a first means for receiving a pivot pin, said first means located adjacent to the corner formed by the intersection of said first and third edges;

iii) a second means for receiving a pivot pin located adjacent to said third edge at a predetermined distance from said first edge and aligned approximately equidistant with said first means for receiving a pivot pin from said third edge;

iv) a linear guide slot located substantially parallel to and adjacent to said fourth edge, and the region adjacent to said linear slot having at least one set of marks corresponding to a preselected set of pitch angles;

v) an arcuate guide slot located substantially radially from said first means for receiving a pivot pin, and the region adjacent to said arcuate slot having marks corresponding to a preselected set of degree graduations;

b) a first pivot pin capable of being removably secured in at least one of said pivot pin receiving means;

c) a second pivot pin capable of being removably secured in at least one of said guide slots in any preselected position therein.

2. The layout tool of claim 1 wherein said first and said second means for receiving a pivot pin are pivot pin holes.

3. The layout tool of claim 1 wherein said first means for receiving a pivot pin is a first end of a third guide slot and said second means for receiving a pivot pin is a second end of said third guide slot, wherein said third guide slot is located substantially adjacent to said third edge, said first end being adjacent to the corner formed by the intersection of said first and third edges and said second end at a predetermined distance from said first end and aligned approximately equidistant with said first end from said third edge.

4. The layout tool of claim 3 wherein said third guide slot is curved.

5. The layout tool of claim 3 wherein said third guide slot comprises linear segments.

6. The layout tool of claim 1 further comprising a first view hole located between said arcuate guide slot and said first pivot pin receiving means.

7. The layout tool of claim 6 further comprising a second view hole located between said arcuate guide slot and said linear guide slot.

8. The layout tool of claim I further comprising a first drill hole located adjacent to said first edge of said body at a predetermined distance from said third edge.

9. The layout tool of claim 8 further comprising a second drill hole located between said first drill hole and said arcuate slot at a predetermined distance from said first edge and aligned approximately equidistant with said first drill hole from said third edge.

10. The layout tool of claim 9 wherein said first and second drill holes have diameters of three-eighth inch.

11. The layout tool of claim 1 wherein said linear guide slot further comprises a detent at a predetermined distance from said first edge and aligned equidistant with said second pivot pin receiving means from said first edge.

12. The layout tool of claim 1 wherein the regions adjacent said third edge, said first edge and said relieved portion of said second edge are calibrated in linear measure.

13. The layout tool of claim 1 wherein said first pivot pin comprises two cylidrical caps capable of being removably secured by a stud.

14. The layout tool of claim 1 wherein said first pivot pin comprises two cylidrical caps capable of being removably secured by a stud threaded at the ends thereof.

15. The layout tool of claim 1 wherein said first pivot pin comprises two cylidrical caps removably secured by a stud threaded at one end and permanently fixed to one of said cylindrical caps.

16. The layout tool of claim 1 wherein said at least one set of marks adjacent to said linear slot has marks corresponding to a preselected set of pitch angles for common rafters.

17. The layout tool of claim i wherein said at least one set of marks adjacent to said linear slot has marks corresponding to a preselected set of pitch angles for hip and valley members.

18. The layout tool of claim 1 wherein said first and second edges are approximately 5.5 inches in length.

19. The layout tool of claim 1 wherein said relieved portion of said second edge forms a void which is approximately 3.5 inches in length and 3 inches in depth.

20. The layout tool of claim 1 wherein said third and fourth edges are approximately 8.625 inches in length.

* * * * *